United States Patent [19]

Helton et al.

[11] 3,961,788

[45] June 8, 1976

[54] BULLDOZER BLADE WITH IMPROVED TIP AND END BIT

[75] Inventors: Eugene L. Helton, Peoria, Ill.; Nathan Gutman, Loudonville, N.Y.; Donald E. Ribbing, Joliet, Ill.

[73] Assignee: Caterpillar Tractor Co., Peoria, Ill.

[22] Filed: Feb. 7, 1975

[21] Appl. No.: 548,111

[52] U.S. Cl. ..... 172/777; 37/141 R; 37/141 T; 172/719; 172/767; 172/801

[51] Int. Cl.[2] ..... E02F 3/60; E02F 3/76

[58] Field of Search ..... 172/713, 719, 753, 765, 172/766, 767, 770, 771, 772, 777, 801, 768, 769; 37/141 R, 141 T, 142 R, 142 A

[56] References Cited

UNITED STATES PATENTS

| | | | |
|---|---|---|---|
| 1,837,341 | 12/1931 | Shaffer | 37/142 R |
| 2,732,639 | 1/1956 | Lillengreen | 172/777 |
| 2,841,897 | 7/1958 | Duke | 172/767 X |
| 2,914,868 | 12/1959 | Launder | 172/777 |
| 2,965,989 | 12/1960 | Hibbard | 172/777 |
| 3,029,534 | 4/1962 | Rakisits | 37/141 R |
| 3,038,267 | 6/1962 | Helton et al. | 172/777 |
| 3,436,849 | 4/1969 | Haynes | 37/141 R |
| 3,456,370 | 7/1969 | Gilbertson | 172/777 X |
| 3,621,594 | 11/1971 | Hahn et al. | 37/142 R X |
| 3,638,736 | 2/1972 | Hahn | 172/719 |
| 3,736,675 | 6/1973 | Shankwitz et al. | 37/141 R |
| 3,812,608 | 5/1974 | Ratkowski | 37/141 T |
| 3,851,413 | 12/1974 | Lukavich | 37/141 T |

*Primary Examiner*—Richard C. Pinkham
*Assistant Examiner*—Richard T. Stouffer
*Attorney, Agent, or Firm*—Phillips, Moore, Weissenberger Lempio & Strabala

[57] ABSTRACT

A bulldozer blade comprises an upright member having a pair of laterally spaced end plates and a transversely disposed cutting edge secured thereon. A mounting plate is secured forwardly on the outboard side of each of the end plates and an adapter is secured forwardly on each of the mounting plates. An end bit and an earthworking tip are detachably mounted on each of the adapters.

8 Claims, 4 Drawing Figures

BULLDOZER BLADE WITH IMPROVED TIP AND END BIT

BACKGROUND OF THE INVENTION

This invention relates to an earthworking tool, such as a bulldozer blade, having a hardened earthworking tip detachably mounted forwardly on each lateral side thereof. Bulldozer blades constitute one of the most versatile tools employed in the earthworking industry in that they are adapted to pioneer roads, grub tree stumps, dislodge and move boulders and grade rocky terrain. Such work applications subject the blade and its attendant cutting edge and tips to high rates of stress and wear.

The bulldozer blade must thus exhibit very high strength and durability characteristics and must also exhibit the capability of being readily serviceable for repair purposes. It is further desirable that certain of the structural members, integrated into the bulldozer blade, perform dual functions to minimize the complexity and cost thereof. Conventional cutting edges and end bits, for example, normally require complete replacement even though major portions thereof remain functional.

SUMMARY OF THIS INVENTION

An object of this invention is to overcome the above, briefly described problems by providing an economical and durable earthworking tool which is adapted for expeditious repair. The earthworking tool, preferably constituting a bulldozer blade, comprises an upright member having a pair of laterally spaced end plates secured on the ends thereof and a mounting plate secured forwardly on each of the end plates. An adapter is secured on a forward end of each of the mounting plates and a hardened earthworking tip is detachably mounted on each of the adapters. In the preferred embodiment of this invention, the mounting plates are each secured on an outboard side of a respective end plate and an end bit is disposed on an exposed forward edge of each of the end plates in protective relationship thereon.

BRIEF DESCRIPTION OF THE DRAWINGS

Other objects of this invention will become apparent from the following description and accompanying drawings wherein.

DETAILED DESCRIPTION OF THE INVENTION

Figure 1:
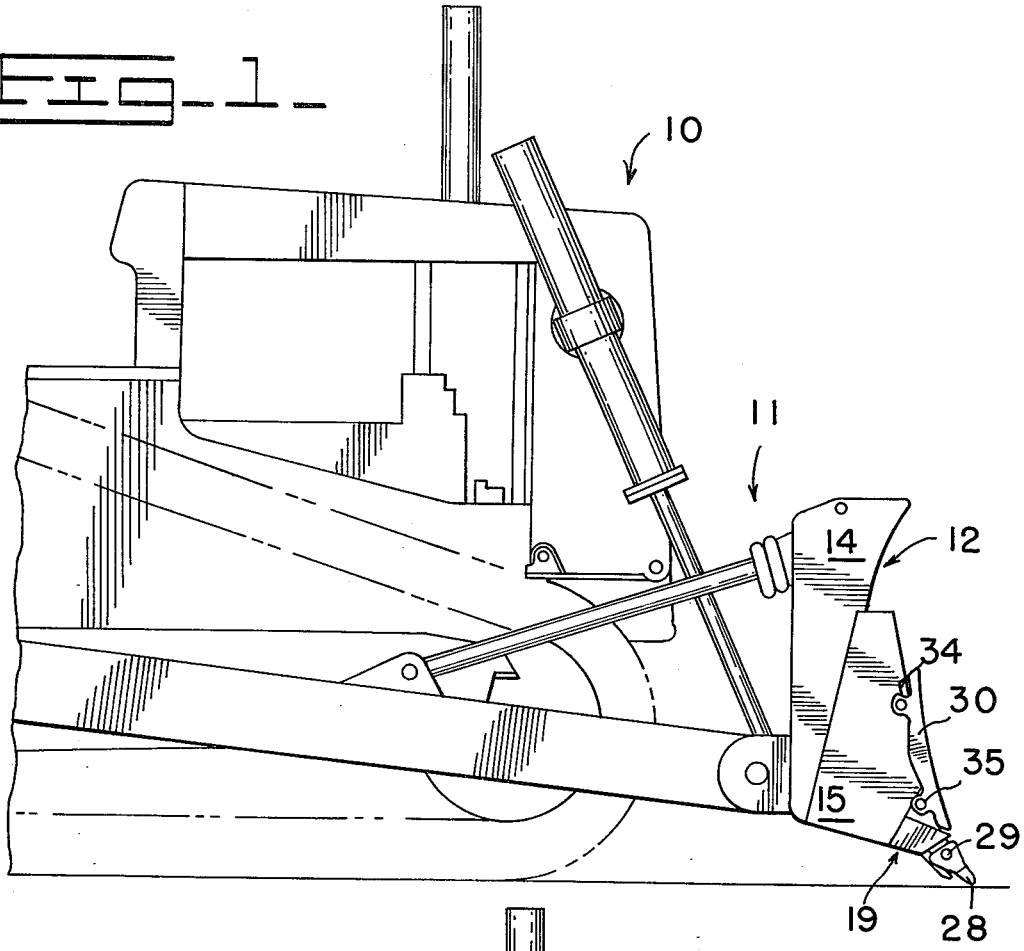
FIG. 1 is a partial side elevational view of the forward end of a track-type tractor having a bulldozer assembly mounted thereon.
Figure 2:
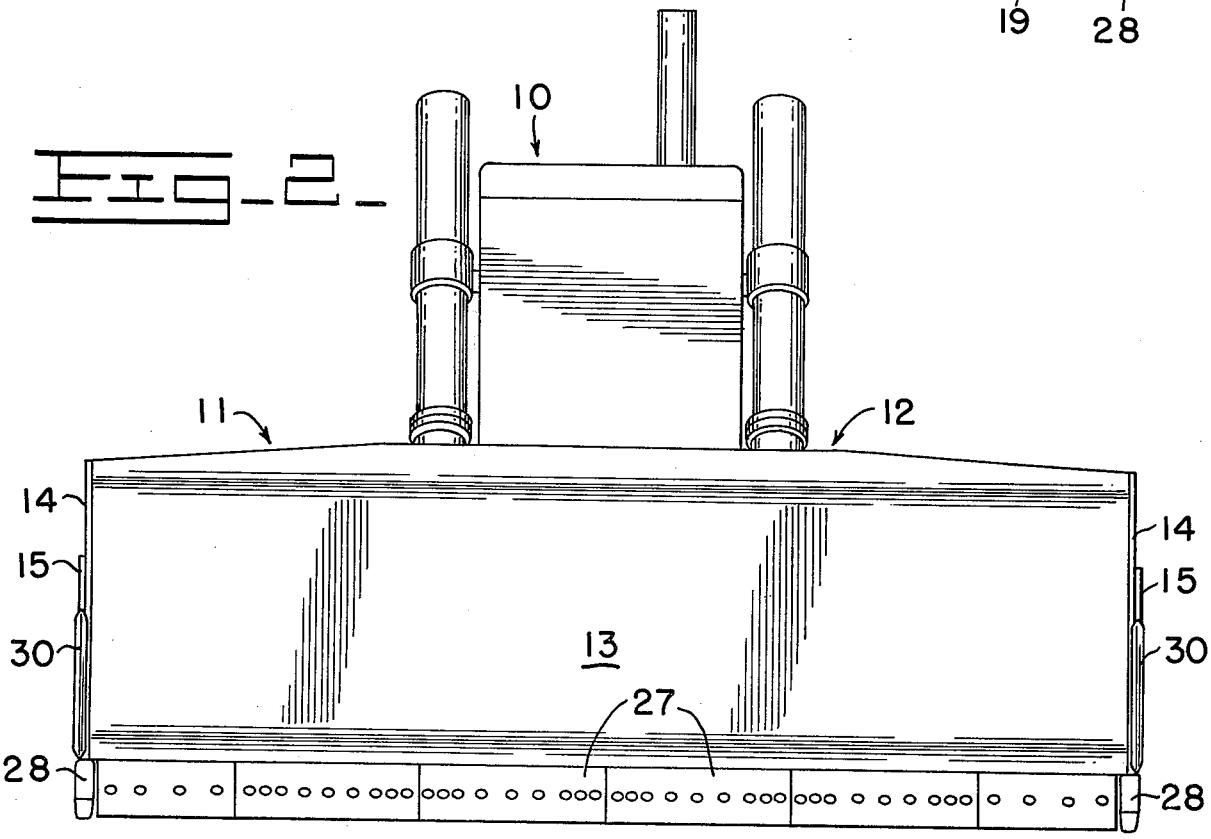
FIG. 2 is a front elevational view of the tractor and bulldozer assembly.

FIG. 1 illustrates a conventional track-type tractor 10 having a bulldozer assembly 11 mounted thereon in a conventional manner. The bulldozer assembly comprises a blade 12 including an upright member 13 having a pair of laterally spaced plates 14 secured on the ends thereof. Although the invention hereinafter described is particularly adapted for use with a bulldozer blade, it should be understood that such invention is adapted for use with other earthworking tools such as loader buckets and the like.

Figure 4:
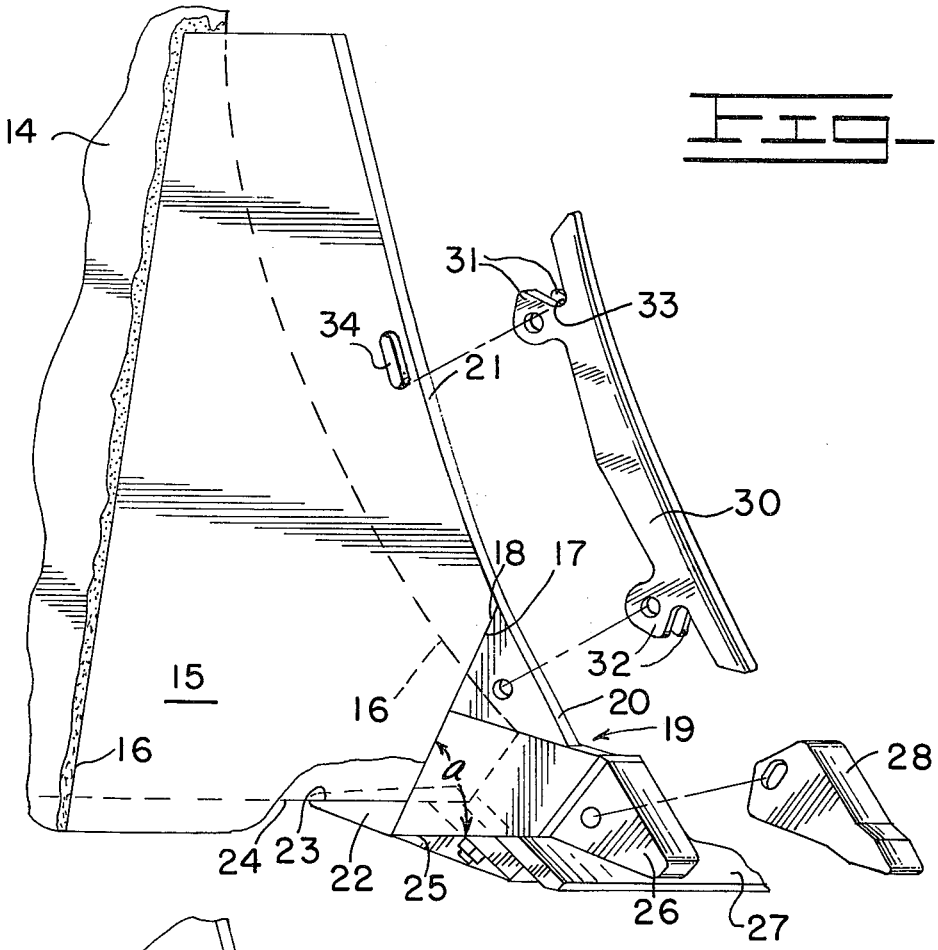
FIG. 4 is a view similar to FIG. 3, but showing the adapter secured to the bulldozer assembly and further showing an end bit and tip prior to their attachment to the adapter.
Figure 3:
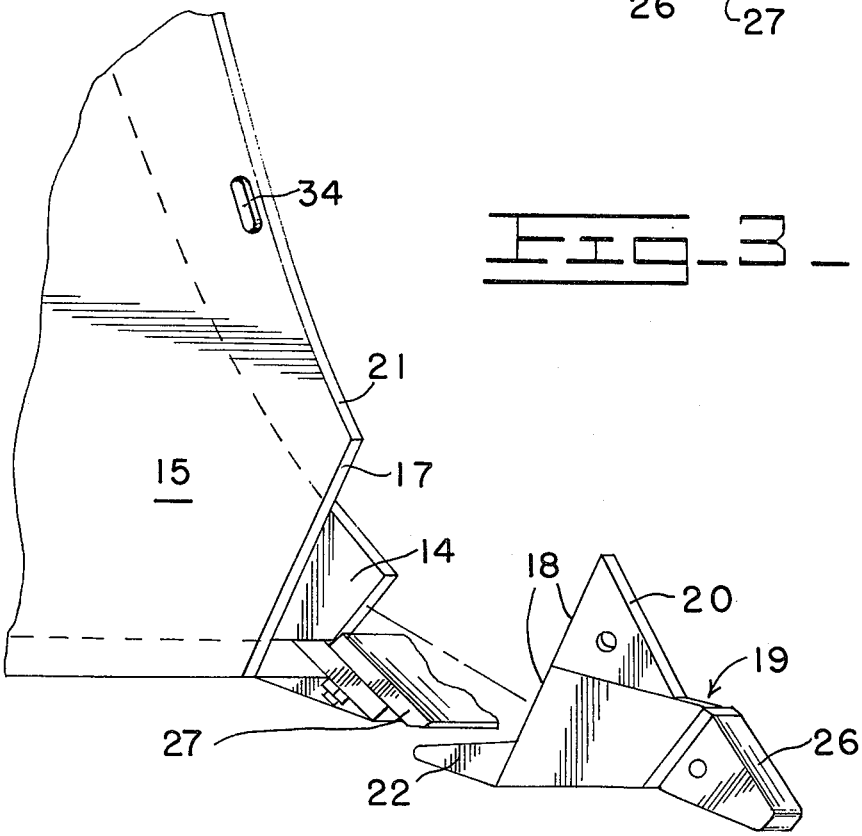
FIG. 3 is an enlarged partial isometric view of a corner construction employed on a blade of the bulldozer assembly and showing an adapter prior to its securance thereto.

Referring to FIGS. 3 and 4, each integrated corner construction of the bulldozer blade comprises a generally triangularly shaped mounting plate 15 secured forwardly on a respective end plate 14 and on an outboard side thereof by welds 16. The mounting plate terminates forwardly at a straight edge 17 having a co-extensive straight edge 18 of an adapter 19 suitably secured thereto by welds or the like. The generally triangularly shaped adapter comprises an upper edge 20 which is aligned in flush relationship with respect to an upper edge 21 of mounting plate 15 to provide a smooth transition therebetween.

A projection 22 extends rearwardly from the adapter and has its straight upper edge 23 welded to an underside of a bottom plate 24 of upright member 13. A straight lower edge 25 of the adapter is preferably disposed at an angle *a* with respect to abutting straight edges 17 and 18 which is selected from the range of 45° to 85° and which approximates 65° in FIG. 3. Such angular disposition of the adapter, relative to mounting plate 15, functions to efficiently absorb digging forces imposed on a forwardly extending mounting projection 26 of the adapter during operation of the bulldozer blade.

The bulldozer blade further comprises a segmented cutting edge 27 bolted or otherwise suitably secured on a lower forward edge thereof. A replaceable hardened tip 28 is mounted on each mounting projection 26 by a removable pin 29 (FIG. 1). A reversible hardened end bit 30 of conventional design has a pair of identical mounting flanges 31 and 32 formed on the underside thereof, as more clearly shown in FIG. 4.

The end bit is mounted on edges 20 and 21 to provide frontal protection thereat to further increase the life expectancy of the bulldozer blade. Upper flanges 31 define a notch 33 which engages an underside of a retainer 34, secured on an outboard side of mounting plate 15. Lower flanges 32 are removably attached to adapter 19 by a releasable pin 35 (FIG. 1).

One of the features of this invention is the ability to adapt mounting plate 15 and adapter 19 to a conventional bulldozer blade. Such adaption substantially increases the structural integrity of the working corners of the bulldozer blade and provides for efficient absorption of working forces imposed on tip 28 by the blade. Since end bit 30 is located above tip 28, away from the working area of tip 28, the life expectancy thereof will be substantially increased over conventional end bit constructions and arrangements.

We claim:

1. An earthworking tool comprising an upright member having a pair of laterally spaced end plates secured on the ends thereof, a pair of mounting plates each secured forwardly on and on an outboard side of a respective one of said end plates, a pair of adapters each secured forwardly on a respective one of said mounting plates, and a pair of hardened earthworking tips each detachably mounted forwardly on a respective one of said adapters, each of said mounting plates terminating at a forwardly disposed straight edge secured at a co-extensive straight edge of a respective one of said adapters and wherein said edges define an acute angle with respect to a bottom straight edge of a respective one of said adapters selected from the range of from 45° to 85°.

2. The earthworking tool of claim 1 wherein said tool constitutes a bulldozer blade further comprising a cutting edge attached on a lower forward edge thereof and extending between said tips.

3. The earthworking tool of claim 1 wherein a forward end of each of said adapters terminates at a wedge shaped mounting projection having one of said hardened earthworking tips detachably mounted thereon.

4. The earthworking tool of claim 3 wherein forwardly disposed top edges of a said mounting plate and a respective one of said adapters are aligned in at least substantially flush relationship relative to each other and further comprising an end bit mounted on said aligned top edges and detachably mounted on said adapter.

5. The earthworking tool of claim 1 wherein each of said adapters comprises a projection extending rearwardly therefrom and secured to an underside of said upright member.

6. An earthworking tool comprising an upright member having a pair of laterally spaced end plates secured on the ends thereof, a pair of mounting plates each secured forwardly on and on an outboard side of a respective one of said end plates, a pair of adapters each secured forwardly on a respective one of said mounting plates, a pair of hardened earthworking tips each detachably mounted forwardly on a respective one of said adapters, a forward end of each of said adapters terminating at a wedge shaped mounting projection having one of said hardened earthworking tips detachably mounted thereon and wherein forwardly disposed top edges of one of said mounting plates and a respective one of said adapters are aligned in at least substantially flush relationship relative to each other, and an end bit mounted on said aligned top edges and detachably mounted on one of said adapters.

7. The earthworking tool of claim 6 wherein each of said mounting plates terminates at a forwardly disposed straight edge secured at a co-extensive straight edge of a respective one of said adapters.

8. The earthworking tool of claim 7 wherein said edges define an acute angle with respect to a bottom straight edge of a respective one of said adapters selected from the range of from 45° to 85°.

* * * * *